United States Patent [19]

Newman et al.

[11] 3,971,518

[45] July 27, 1976

[54] TRANSFER TAIL APPARATUS FOR USE WITH TEXTILE YARN WINDERS

[75] Inventors: Larry B. Newman; John W. Demuth, both of Kingsport, Tenn.

[73] Assignee: Eastman Kodak Company, Rochester, N.Y.

[22] Filed: Nov. 18, 1974

[21] Appl. No.: 524,902

[52] U.S. Cl. ..... 242/18 PW

[51] Int. Cl.[2] ..... B65H 54/02

[58] Field of Search ..... 242/18 PW, 18 A, 18 DD

[56] References Cited

UNITED STATES PATENTS

| | | | |
|---|---|---|---|
| 3,149,795 | 9/1964 | Rhein, Jr. | 242/18 A |
| 3,224,692 | 12/1965 | Nugent | 242/18 PW |
| 3,251,560 | 5/1966 | Macedo | 242/18 PW |
| 3,275,252 | 9/1966 | Bolger | 242/18 PW |
| 3,276,704 | 10/1966 | Pabis | 242/18 PW |
| 3,282,516 | 11/1966 | Porter | 242/18 PW |
| 3,408,011 | 10/1968 | Lenk et al. | 242/18 PW |
| 3,428,266 | 2/1969 | Emery | 242/18 PW |
| 3,575,355 | 4/1971 | Ratti | 242/18 PW |
| 3,792,818 | 2/1974 | Bauer et al. | 242/18 PW |

*Primary Examiner*—Stanley N. Gilreath
*Attorney, Agent, or Firm*—Malcolm G. Dunn; Daniel B. Reece, III

[57] ABSTRACT

Transfer tail apparatus for use with a yarn winder on which the yarn package tube has at its outer axial end an end slit or other yarn snagging means for snagging and retaining yarn during tie-up, the transfer tail apparatus having a first yarn guide adapted to move in a path and translate a continuously moving yarn into engagement with the tube end slit or other yarn snagging means; and a second yarn guide operative after such snagging and adapted to guide the snagged yarn into a waste bunch and then move in a path and guide the yarn into spaced helical wraps constituting the transfer tail, after which the second yarn guide releases the yarn for subsequent pickup by a yarn traverse guide on the yarn winder for forming the package portion on the yarn package tube.

7 Claims, 4 Drawing Figures

TRANSFER TAIL APPARATUS FOR USE WITH TEXTILE YARN WINDERS

BACKGROUND OF THE INVENTION

This invention is directed to a transfer tail apparatus for use with textile winders on which textile and industrial yarns are wound into packages, and particularly to an apparatus for forming a transfer tail on a yarn package support or tube, which is rotating at high speeds.

Devices and apparatus for forming transfer tails on yarn package supports, particularly on yarn package supports that are rotating at the desired yarn package winding speeds, are well known in the art. Some of these prior art devices or apparatus are represented in the Pabis patent, U.S. Pat. No. 3,276,704; the Rhein, Jr. patent, U.S. Pat. No. 3,149,795; the Nugent Patent, U.S. Pat. No. 3,224,692; the Ratti patent, U.S. Pat. No. 3,575,355; the Emery patent, U.S. Pat. No. 3,428,266; the Porter patent, U.S. Pat. No. 3,282,516; and the Bolger patent, U.S. Pat. No. 3,275,252.

The textile winders concerned with this invention usually involve a yarn package support, which may be surface-driven, and where the traversing action for even distribution of the yarn on the yarn package support may be obtained by use of a drive roll having a spiral groove in its surface to traverse the yarn as it is wound on the package, as in the case of the above-mentioned Nugent patent, U.S. Pat. No. 3,224,692. The traversing action may also be accomplished by the reciprocating motion of a yarn traverse guide through which the yarn advances to the yarn package support or tube, as in the case of the above-mentioned Pabis patent, U.S. Pat. No. 3,276,704.

The "transfer tail" is an initial wrap or turn or series of wraps or turns in the form of a single layer of a short length of helices at one end of the yarn package support or tube just outside the package portion of the tube. The purpose of the transfer tail is to facilitate the tying of the outer end of yarn from another yarn package to the transfer tail of the yarn package being processed or used in a textile mill so as to preserve the continuity of the operating process without having to shut equipment down when a yarn package becomes depleted.

The winder for which this invention, the transfer tail apparatus, is particularly adapted is the BARMAG SW4S Winder, Barmer Machinenfabrik A.G., which winds yarn onto packages at speeds in excess of 3000 meters per minute. In making transfer tails on yarn packages at these speeds any excessive slack in the winding system at the moment of the tie-up or connection of the yarn to the yarn package support or tube can cause a number of problems.

Initially, before tie-up of the yarn to the yarn package tube, the yarn is traveling toward the winder at speeds in excess of 3000 meters per minute. The yarn is being taken up by a waste aspirator or air doffer, which also serves to maintain the desired tension on the yarn. Any momentary excessive slack in tension at the moment of tie-up to the yarn package tube can cause roll wrap around the godet roll that precedes the winder. The roll wrap would thus cause a breakdown of the system. If, for whatever reason, a roll wrap should fortuitously be avoided, despite the presence of undesirable slack, and a successful tie-up should be made to the yarn package tube, slack yarn will be present in the first few layers of yarn on the yarn package tube. This can cause separated or spread filaments next to the surface of the tube, and thus cause damaged filaments.

Another problem resulting from undesirable slack is that the yarn is not pulled sufficiently tight on the traverse guide, and thus on the pickup of the yarn by the traverse guide the latter does not pick up all of the filaments at the same time, but instead picks up the remainder on the next reciprocation. This results in the filaments becoming undesirably separated, the filaments being out of phase with the other filaments and tending to cause a breakdown of the yarn end.

Still another problem resulting from excessive slack: Since the yarn layers next to the tube surface are not tensioned the same as the outer yarn layers, a potential dye take-up difference problem is created.

The separated filament problem also extends to the transfer tail when the yarn is either of low twist or is a non-TF (non-entangled filament) yarn. The filaments become separated in the transfer tail, with the possibility that the entire strand of yarn may not be tied-up to the next successive package during yarn processing. If the filaments are picked up out of phase, some of the yarn strands will be drawn more than other strands when the yarn being wound is only partially oriented. When such yarn is later processed, as by undergoing a draw texturing operation, in any dye operation the resulting different dye take-up may cause little flashes in fabric made from such yarn.

An object of the present invention is to reduce slack in the yarn to a minimum at the time of tie-up or connection of the yarn to the yarn package support or tube.

Some of the transfer tail apparatus and devices in the prior art depend on yarn tension for causing movement of the transfer tail device. Since yarn tension can vary, this will result in different movement or rotational rates in the transfer tail device which may thus cause the helices to be too closely spaced so as to make it difficult for the operator to find a yarn end and tie-up to the next yarn package. If the transfer tail is too widely spaced, the length of the tail may be too short to enable tie-up to the next yarn package.

For instance, the transfer tail device provided by Barmer Machinenfabrik A.G. on the Barmag SW4S winder comprises a light-weight arm that rotates as a result of the yarn releasing a latch and exerting a force on the arm by the tension of the yarn. The spacing between helices or turns in the transfer tail on the yarn package tube depends on the rate of rotation of the arm which in turn depends upon the tension of the yarn, bearing friction, and inertia of the arm. The latch is connected to the arm, and adjustments to account for changes in the path of the yarn to insure proper release of the latch alter the inertia of the arm. Small changes in the inertia and friction will occur and affect the rotation of the arm since the low yarn tension forces are the only forces for causing rotation of the light-weight arm.

An object of the invention, therefore, is to provide an apparatus which will enable winding of transfer tails on yarn package tubes in a controlled, repeatable manner independent of variations in yarn tension, path of the yarn, and friction changes.

Another object of the present invention is to provide a transfer tail apparatus in which yarn tension is a negligible factor in the operation of the transfer tail apparatus. Yarn tension is relied on only to hold the yarn in its proper place in the transfer tail apparatus as the yarn approaches the winder. Thus, since the transfer tail apparatus is not dependent upon yarn tension for its operation, such yarn tension otherwise tending to be variable, repeatability of the desired transfer tail is made more certain.

SUMMARY OF THE INVENTION

The invention thus concerns a transfer tail apparatus which is adapted to form a transfer tail on the outer end portion of a rotating yarn package tube when the yarn is traveling at speeds in excess of 3000 meters per minute. The transfer tail apparatus, of course, is also capable of being used with winders operating at slower speeds. The rotating yarn package tube is horizontally mounted on a yarn winder. The yarn winder has a self-threading yarn traverse guide, which is driven in reciprocation along a path that is parallelly spaced from the package portion of the yarn package tube and which guides the yarn onto the package portion of the tube. The yarn package tube has formed in its outer axial end an end slit for snagging and retaining yarn. Other yarn snagging arrangements may be provided in addition to the end slit in the tube such as an arrangement that is part of the tube or that is part of the mandrel on which the tube is mounted for rotation. It is only necessary that the snagging arrangement be at a location at the outer axial end of the tube where there is no interference with the surface drive of the yarn package tube or the formation of any of the wraps on the tube. It is also necessary that the snagging arrangement be effective in enabling the yarn to commence winding on the yarn package tube.

The transfer tail apparatus includes a yarn laying guide and a pigtail yarn guide, through each of which the continuously moving yarn is initially threaded by the operator by means of an air doffer in preparation for tie-up or connection of the yarn to the rotating yarn package support or tube. The yarn laying guide and pigtail yarn guide are each adapted to be moved in a predetermined path, in this instance in an arcuate path, from a first position to a latched second position; and upon release from the latched position, to be moved in return along the path to the first position. The movement of each of the two guides is powered and controlled by a spring arrangement, which is adjustable and is sufficiently large and steady as compared to the tension on the yarn and to any frictional changes in the system.

As the pigtail yarn guide is moved by the spring arrangement along the predetermined path in return to the first position from the latched position, the pigtail yarn guide translates the yarn into engagement with the outer axial end of the yarn package tube, whereupon the yarn becomes snagged and retained on the tube by the end slit when the end slit rotates into the snagging position. In the instance of other yarn snagging arrangements located at the outer axial end of the yarn package tube, either as part of the tube or otherwise, the movement of the pigtail yarn guide would still bring the continuously moving yarn across at the outer axial end of the tube where the yarn snagging arrangement would be located. The yarn is then severed by snapping from the yarn continuing on to the air doffer as a result of the sudden increase in tension between the snagged yarn and the yarn passing into the air doffer. The yarn laying guide then guides the yarn into a waste bunch of a predetermined number of wraps on the outer axial end of the yarn package tube sufficient to assure retention of the yarn on the yarn package tube, after which the yarn laying guide is automatically released for movement in return to its first position. In the course of its return movement, the yarn laying guide is moved at such a rate relative to the rotation of the yarn package tube as to form on the yarn package tube a transfer tail of a predetermined number of spaced wraps or helices, and then releases the yarn for subsequent pickup by the self-threading yarn traverse guide to thereafter wind yarn on the package portion of the yarn package tube.

The automatic release of the yarn laying guide from its latched position is preferably controlled by the pigtail yarn guide when it reaches a predetermined position along its path of return movement. Suitable mechanism linking the pigtail yarn guide with the yarn laying guide may be provided, such as a mechanically-activated or electrically activated time delay mechanism, which may be triggered after a predetermined interval following release from the latched position of the pigtail yarn guide.

The yarn laying guide is generally U-shaped in configuration, has two spaced leg portions that are inclined upwardly and lie in planes extending above the axis of the yarn package tube and extend generally toward the yarn package tube when the yarn laying guide is in the latched second position. One of the leg portions is offset below and toward the other leg portion, and the other leg portion terminates in a L-shaped leg portion that lies above the first mentioned leg portion. The L-shaped leg portion is generally parallel with the yarn package tube and extends in a direction toward the outer axial end of the yarn package tube when the yarn laying guide is in the latched second position.

When the yarn laying guide and the pigtail yarn guide are in their respective latched positions, the pigtail guide is then located in front of the outer axial end of the horizontally disposed yarn package tube; and the yarn laying guide is located at about the 10 o'clock position, relative to the location of the pigtail guide and adjacent the outer axial end of the yarn package tube. The yarn, prior to tie-up, approaches the yarn winder from at least one godet roll above and axially inwardly to one side of the winder, passes over a pair of guide bars, which extend horizontally from the yarn winder a predetermined distance axially inwardly from the outer axial end of the yarn package tube and are positioned parallel to the yarn package tube. Then the yarn passes through the yarn laying guide, through the pigtail guide and into a yarn waste receiver by means of an air doffer or other yarn aspirating device. When the pigtail yarn guide is released from its latched position by the operator, it translates the continuously moving yarn into engagement with the outer axial end of the rotating yarn package tube, and when the end slit on the tube, or other yarn snagging arrangement at the outer axial end of the tube, comes around in clockwise manner to about the 10 o'clock position on the tube, as viewed when standing in front of the outer axial tube end or relative to the location of the pigtail guide, the snagging operation takes place. When the yarn is snagged, the sudden increase in tension on the yarn between the tube end slit or yarn snagging arrangement and the yarn passing into the yarn aspirating device or air doffer causes the yarn to snap or become severed. The yarn is then retained on the tube for subsequent winding thereon. Since the snagging operation takes place substantially in line with the path of approach of the yarn and also the final path of the yarn when the waste bunch commences to be formed, any tendency for any slack to occur in the yarn between the location of the snagging operation and the last godet roll is minimized.

When the yarn is finally released from the yarn laying guide for subsequent pickup by the self-threading yarn traverse guide, the tension on the yarn from above and axially inwardly of the yarn package tube cause the yarn to continue to be moved axially inwardly a short distance along the pair of horizontally extending guide bars and then into the self-threading yarn traverse guide.

DESCRIPTION OF THE PREFERRED EMBODIMENT

Figure 1:
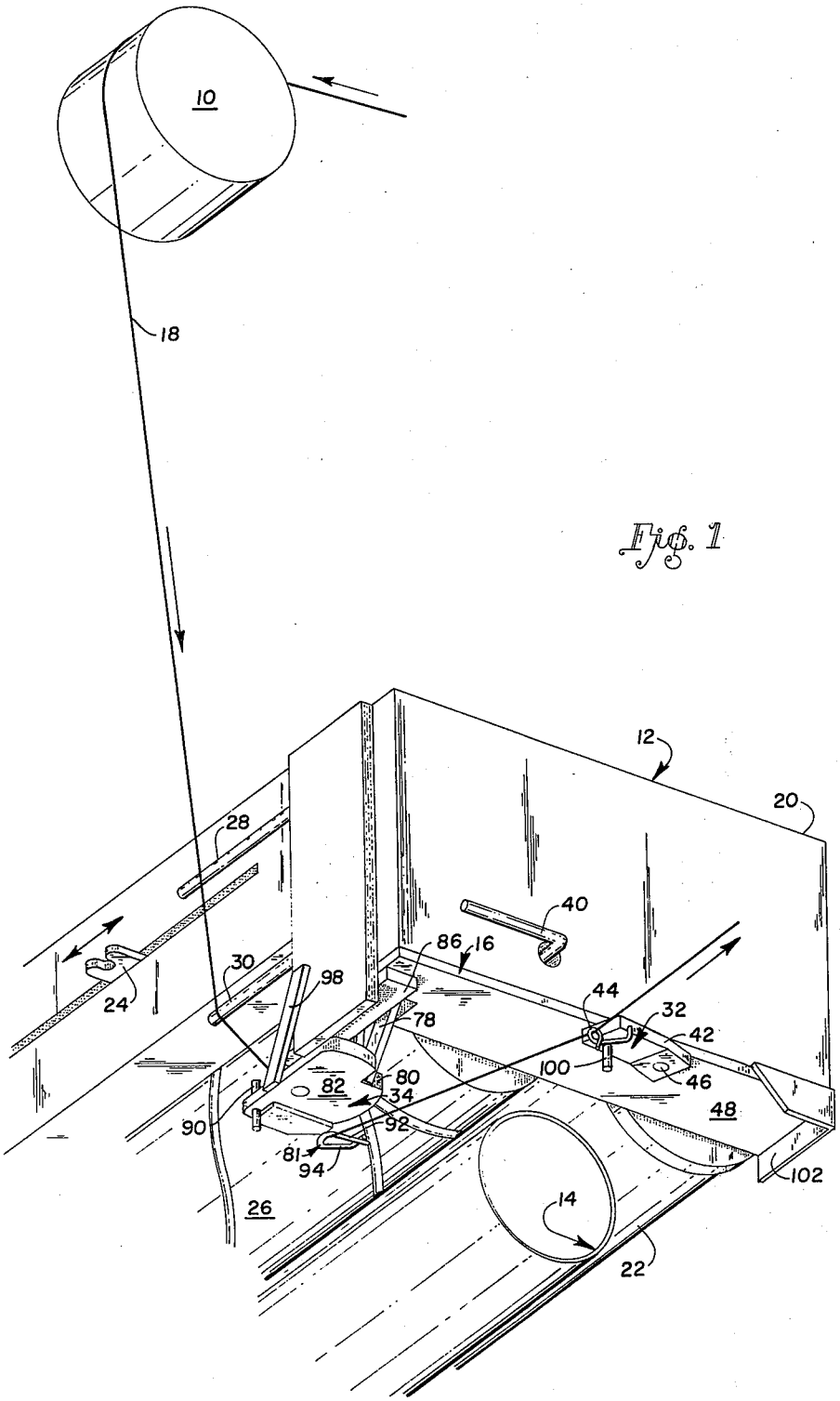
FIG. 1 is an overall isometric view of the transfer tail apparatus, as connected to a yarn traverse winder, and illustrates the path of yarn approach from a godet roll located above the winder.

In reference to FIG. 1 of the drawings, a godet roll is shown at 10, the yarn traverse winder at 12, yarn package support or tube at 14, and the transfer tail apparatus at 16. The yarn 18 approaches the winder from godet roll 10, and initially passes through an air doffer (not shown) to a waste receiver (not shown) prior to being connected to the yarn package tube 14.

The particular yarn traverse winder illustrated is the BARMAG SW4S winder made by Barmer Machinenfabrik A.G., as previously indicated. The pertinent portions of the winder shown include the yarn traverse winder housing 20, which is suitably, vertically movable toward and away from the yarn package tube; the drive roll 22 for surface drive engagement with the yarn package tube; a self-threading yarn traverse guide 24 and a grooved roll 26, each of which cooperate in a known manner to guide the yarn onto the package portion of the yarn package tube; and a pair of guide bars 28, 30, which extend horizontally a predetermined distance axially inwardly from the outer axial end of the yarn package tube and are positioned parallel to the yarn package tube. The guide bars 28, 30, initially serve to prevent the yarn from being picked up by the yarn traverse guide prior to tie-up of the yarn to the yarn package tube. The guide bars also serve another purpose, which will be described later.

In reference now to all of the drawing figures, the transfer tail apparatus 16 comprises a first yarn guide or pigtail yarn guide 32 and a second yarn guide or yarn laying guide 34, each of which are adapted to be moved in a predetermined path, or in a substantially horizontal plane, as illustrated in the particular preferred embodiment shown in these drawings. The "first" and "second" designations of the two yarn guides are in the order of the occurrence of their respective operations and not in the order of the path of approach of the yarn to the winder.

Each of the pigtail guide 32 and yarn laying guide 34 includes, respectively, a latching mechanism 36, 38 for latching the respective yarn guides in a latched second position upon the yarn guides being moved in their respective paths from a first position to the latched second position in preparation for tie-up of the yarn to the yarn package tube.

Figure 2:
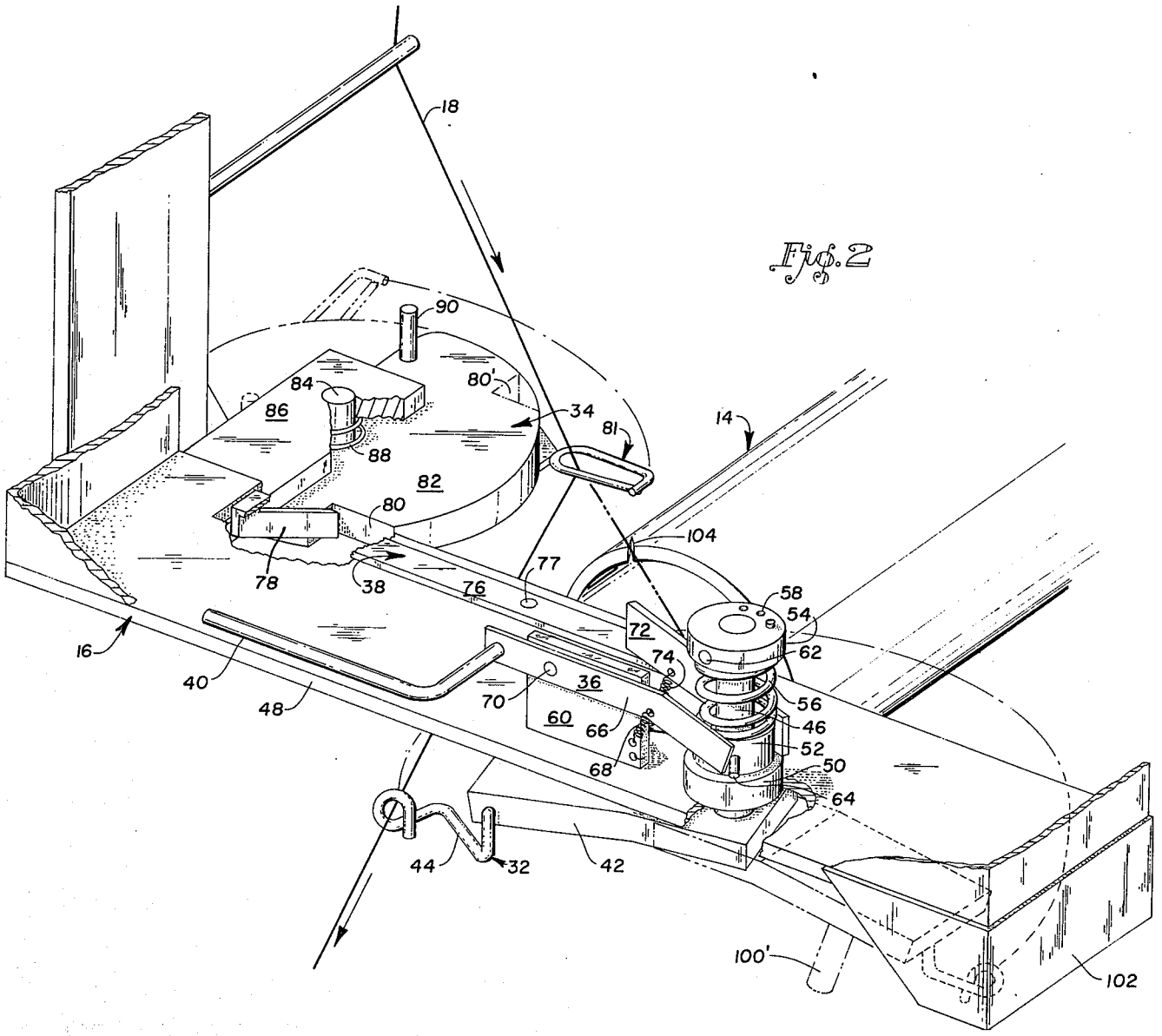
FIG. 2 is an isometric view of the transfer tail apparatus relative to the outer axial end of the yarn package tube and the end slit in the tube, illustrating in solid lines the initial path of the continuously moving yarn and in phantom lines the path of the yarn at the moment of the snagging operation.

The pigtail yarn guide 32 is preferably, and simply, manually released by the operator by means of the actuating lever 40 (FIGS. 1 and 2). The yarn laying guide 34 is preferably released upon the pigtail yarn guide reaching a predetermined location in its path of movement in return from the latched second position to the first position. The agency of release is also preferably controlled by the movement of the pigtail yarn guide in a manner that will be described.

The pigtail yarn guide 32 includes a holder 42 for the "pigtail" or pigtail guide 44. The holder is pivotally mounted for movement in a predetermined arcuate path by means of a stub shaft 46, which extends through an opening (not illustrated) in the mounting plate 48 extending across the bottom of the yarn traverse winder housing 20. The stub shaft 46 extends through a journal 50, which is fixed on the upper side of the mounting plate, and a pin bushing 52, and is surmounted by an adjustable spring retainer 54. A helical torsion spring 56 is provided between the journal 50 and the adjustable spring retainer 54. One end of the helical torsion spring extends through one of several openings 58 through the adjustable spring retainer, and the other end is hooked in securement around a tubular pin (not illustrated) extending from a latching lever mount plate 60. The torsion spring tension may be suitably adjusted in one manner by extending the one end of the torsion spring 56 through a different opening 58. Another manner of adjustment of the torsion spring tension may be accomplished by removing a tubular pin 62 that extends through the retainer and the stub shaft 46 and re-orienting the adjustable spring retainer 54 in the desired direction relative to the stub shaft 46 and re-securing the tubular pin 62.

When the pigtail yarn guide is moved to latched second position by the operator, the tubular pin 64 extending from the pin bushing 52 is caused to be cammed past the latching lever 66, which in turn is spring-biased by spring 68 so as to hold the tubular pin 64 against the return movement until the actuating lever is manually depressed to release the pigtail yarn guide. The latching lever is pivotally mounted from the latching lever mount plate 60 through the stub shaft 70 which extends into the mount plate. When the actuating lever is depressed, the right-hand end (as viewed in FIG. 2) of the latching lever 66 is pivoted upward to release the tubular pin 64 that serves to hold the pigtail yarn guide in torsion or spring-biased position.

As the tubular pin 64 is rotated around, it serves also to cam the extension trip lever 72 outwardly against the spring-bias of spring 74. The extension trip lever is in turn connected to the pivotally mounted trip lever 76, which pivots around stub shaft 77 and in its turn has extending from its other end a detent trip lever 78 for engaging the detent 80 in the yarn laying guide holder 82. When the extension trip lever 72 is cammed outwardly against its spring-bias, the detent-trip lever 78 is moved out of detent engaging position with the detent 80.

The yarn laying guide 34 includes a generally U-shaped guide 81, the abovementioned holder 82, which in turn is pivotally mounted in a predetermined arcuate path by means of a stub shaft 84 extending through the holder from the support bracket 86. The support bracket in turn is secured to the mounting plate 48. A helical torsion spring 88 is positioned around the stub shaft 84 between the holder 82 and the support bracket 86, with one end (not illustrated) of the spring extending through the support bracket and the other end (not illustrated) extending into a hole (not illustrated) in the yarn laying guide holder 82.

A tubular pin 90 extends through the holder 82 and serves as a cocking lever by which the operator can manually move the yarn laying guide from the first position to the latched second position.

The yarn guide 81 is generally U-shaped in configuration and has two spaced leg portions 92, 94, each of which is inclined upwardly and lies in a plane tending to extend above the axis of the yarn package tube when the yarn laying guide is directed toward the package tube in the latched second position. The first of the leg portions 92 is offset below and toward the second of the leg portions 94, the offset being about 18° from the plane of the yarn laying guide holder 82. The other offset is about 18° from a plane that would otherwise extend along the axis of the first leg portion parallel with a plane extending through the axis of the second leg portion, but for the offset of the first leg portion. The second leg portion 94 is offset from the plane of the yarn laying guide holder by about 30°, and terminates in an L-shaped leg portion 96, that is generally parallel with the yarn package tube (when the yarn laying guide is in the latched second position) and extends in a direction toward the outer axial end of the yarn package tube.

A stop member 98 is secured to the side of the yarn traverse winder housing 20 against which one side of the yarn laying guide holder 82 abuts when the yarn laying guide is moved to the latched second position and when it returns to the first position from the latched second position.

In operation, the operator takes an air doffer (not shown) into which the yarn is moving in excess of 3000 meters per minute, passes the yarn into the U-shaped yarn guide 81 in the first position of the yarn laying guide by threading the yarn past the L-shaped leg portion 96 and into the generally U-shaped configuration defined by spaced leg portions 94, 96. The yarn laying guide is then moved from its first position to its latched second position in which it generally faces the yarn package tube 14.

The pigtail yarn guide, prior to threading therethrough, has preferably been moved from its first position to its latched second position by the operator working the cocking arm 100. The end bracket stop and guard member 102 serves to keep the operator's fingers from using the pigtail guide 44 as a cocking arm because in its path of movement the pigtail guide sweeps around very close to the revolving yarn package tube, which is rotating in excess of 12,000 r.p.m. It also serves as a stop for the pigtail yarn guide when the pigtail yarn guide returns to its first position. The operator then threads the continuously moving yarn into the pigtail yarn guide. The yarn is now running from the godet roll 10 above the yarn winder, past and over the two guide bars 28, 30, through the yarn laying guide 81 along path A (FIG. 4) against the first leg position 92, through the pigtail guide 44 and into the air doffer (not illustrated) to a waste receiver (also not illustrated).

Figure 4:
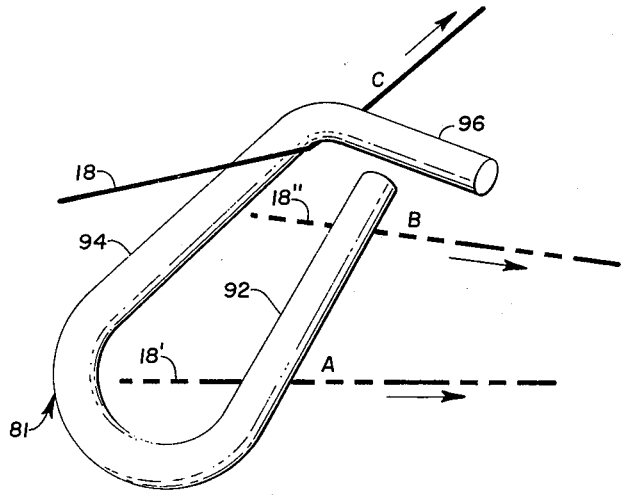
FIG. 4 is an enlarged isometric view of the yarn laying guide illustrating the offset leg portions and in solid and phantom lines the respective locations of the yarn in the yarn laying guide as it is being translated and after such translation by the pigtail yarn guide.
Figure 3:
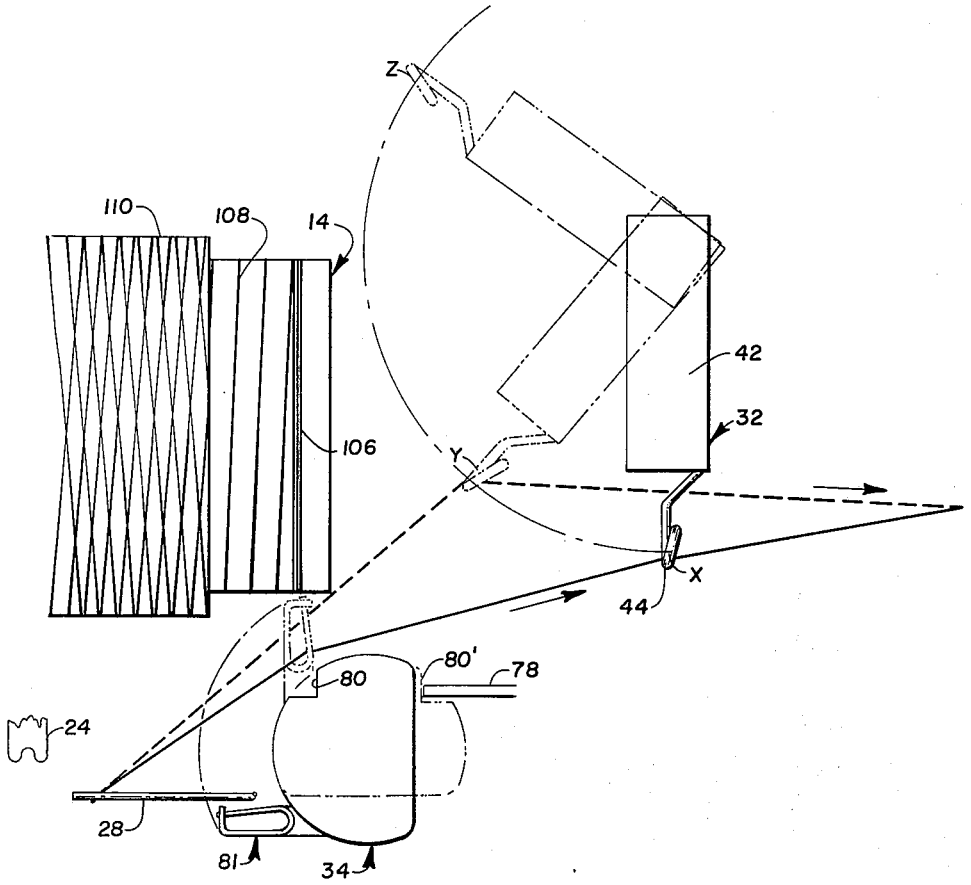
FIG. 3 is a diagrammatic view of a portion of the yarn package tube illustrating the locations of the waste bunch, the transfer tail and the package portion of the tube; and also illustrating in solid and phantom lines the various positions of the yarn laying guide and pigtail guide in their respective paths of movement.

The operator then presses downwardly on the actuating lever 40, thereby releasing the pigtail yarn guide 32 for movement in a predetermined path, as illustrated in FIGS. 2 and 3. The pigtail yarn guide translates the continuously moving yarn 18 into engagement with the outer axial end of the yarn package tube 14 where the end slit 104 rotates around clockwise, as seen from FIG. 1, to snag and retain the yarn on the yarn package tube. The pigtail guide has thus moved from the latched second position X (FIG. 3) to position Y (FIG. 3). The sudden increase in tension between the snagged yarn in the end slit and the yarn passing into the air doffer is such as to cause a snapping of the yarn or severing from the yarn going to the waste receiver. The snagging action takes place at about the 10 o'clock position when facing the yarn tube, as shown in FIG. 2, and at the moment prior to the snagging action, the yarn then moves along path B against the first leg portion 92 of the yarn laying guide 81, as shown in FIG. 4.

When the yarn is snagged, the yarn moves along the path C (FIG. 4) against the L-shaped leg portion and the yarn is wrapped into a waste bunch 106 (FIG. 3) on the yarn package tube. The waste bunch serves to secure and prevent the yarn from slipping off the package tube, prior to the formation of the transfer tail.

The pigtail yarn guide continues to move in return toward its first position and at position Z along the path of return, the yarn laying guide is tripped for release and return to its first position by the interlinking mechanism previously described. As the yarn laying guide moves along its predetermined path, the yarn is formed in spaced wraps or spaced helices 108 ((FIG. 3) until in its path of movement the yarn laying guide swings away from the yarn package tube, thereby releasing the yarn as it slips from the L-shaped leg portion 96 for subsequent pickup of the yarn by the self-threading yarn traverse guide 24.

The tension and angle on the yarn as it moves from the godet roll 10 to the yarn traverse winder 12 causes the yarn to continue to be moved axially inwardly a short distance along the guide bars 28, 30, upon release of the yarn from the yarn laying guide and before pickup by the self-threading traverse guide. Upon such pickup, the package portion 110 on the yarn package tube is then wound. The guide bars 28, 30, as previously indicated, thus serve this additional purpose of guiding the yarn to the yarn traverse guide.

In summary, therefore, the transfer tail apparatus of this invention operates independently of yarn tension. The pigtail yarn guide and the yarn laying guide are each movable in a path from a first position to a latched second position preparatory to yarn tie-up to a yarn package tube mounted on a yarn winder, and upon release return to their respective first positions as they carry out most of their respective yarn guiding functions. The pigtail yarn guide translates or moves the continuously moving yarn into engagement with the end slit on the yarn package tube or other yarn snagging arrangements at the outer axial end of the yarn package tube. The pigtail yarn guide also may serve as a time delay mechanism for initiating release of the yarn laying guide after a predetermined time interval from the snagging of the yarn by the tube end slit or other yarn snagging arrangement. The time interval in the instance of the preferred embodiment would terminate after the formation of the waste bunch on the yarn package tube. The yarn laying guide guides the yarn onto the rotating yarn package tube to form the waste bunch while in the latched second position, then moves along its path in return to its first position guiding the yarn into predetermined spaced helical wraps constituting the "transfer tail" and releasing the yarn for subsequent pickup by the yarn traverse winder. The minimum number of wraps in the waste bunch is preferably about eight to ten wraps so as to assure that the yarn does not pull free from the outer axial end of the yarn package tube. The wraps should not be so numerous as to be undesirably engaged and smeared by the surface drive roll.

The rates of movement of each of the pigtail and yarn laying guides are predetermined relative to the speed of rotation of the yarn package tube. The drive for each movement may be simply provided by a spring of sufficient tension, coupled with a sufficient mass of weight connected with each respective yarn guide as to overcome any effect of yarn tension, of friction between any of the parts of the related or interlinking mechanism, and of inertia.

The spacing of each of the movable yarn guides relative to the end slit on the yarn package tube and to the path of the approach of the yarn and with respect to the rotation direction of the yarn package tube are such that at the moment of snagging of the yarn by the tube end slit, slack in the yarn is significantly minimized to overcome those problems which were outlined above relative to the various undesirable results as a consequence of undesirable excessive slack.

Although the invention has been described in considerably detail with particular reference to certain preferred embodiments thereof, variations and modifications can be effected within the spirit and scope of the invention.

We claim:

1. A transfer tail apparatus adapted to form a transfer tail on the outer end portion of a rotating yarn package tube, which is mounted on a yarn winder having a yarn traverse guide reciprocating along a path parallelly spaced from the package portion of the yarn package tube, the yarn package tube having at its outer axial end yarn snagging means for snagging and retaining yarn on the yarn package tube, the transfer tail apparatus comprising:

a first yarn guide means mounted spaced outwardly from the outer axial end of the yarn package tube and a second yarn guide means mounted spaced outwardly parallel to the axis of the yarn package tube and adjacent to the outer end portion of the yarn package tube, each yarn guide means adapted to receive, retain and engagingly guide a continuously moving yarn from a source of supply to a waste receiver and adapted as mounted so as to be moved in a predetermined path from a first position to a latched second position, and upon release, to be moved in return along a predetermined path to the first position;

each yarn guide means including a latch means for latching the yarn guide means in the latched second position, a release means for releasing the yarn guide means from the latched second position, and means for moving the yarn guide means in return to the first position;

the first yarn guide means adapted upon release from the latched position and movement in return along the predetermined path toward the first position to translate the thus engaged continuously moving yarn into engagement with the outer axial end of the yarn package tube whereupon the yarn snagging means rotates into snagging position, snags and retains the yarn, thereafter causing the yarn to become severed from the yarn going to the waste receiver and to be released from the first yarn guide means;

the second yarn guide means adapted as mounted in the latched second position to guide the thus engaged continuously moving yarn into a waste bunch of predetermined number of wraps on the outer end portion of the rotating yarn package tube, and upon release from the latched second position and movement in return along the predetermined path toward the first position to guide the yarn into a predetermined number of spaced helical wraps along the yarn package tube between the waste bunch and the package portion of the yarn package tube as the second yarn guide means moves and is also adapted at a predetermined point along its path of movement to move out of engagement with and thus release the yarn from the second yarn guide means for subsequent pickup by the yarn traverse guide for winding of the yarn package on the package portion of the yarn package tube; and the release means for the second yarn guide means being actuated for release of the second yarn guide means from the latched second position in response to continued movement of the first yarn guide means toward the first position following the snagging and severing of the yarn, wherein the latch means for the first yarn guide means includes means for actuating the release means for the second yarn guide means.

2. A transfer tail apparatus as defined in claim 1, and wherein the first and second guide means is each movable in rotation along an arcuate path.

3. A transfer tail apparatus as defined in claim 1, and wherein the means for moving each guide means in return to the first position includes a spring drive.

4. A transfer tail apparatus as defined in claim 1, and further comprising a pair of guide bars mounted on the yarn winder and horizontally extending a predetermined distance axially inwardly from the outer axial end of the yarn package tube and positioned parallel to the yarn package tube, and adapted to guide the yarn toward the yarn traverse guide upon release of the yarn from the second guide means.

5. A transfer tail apparatus adapted to form a transfer tail on the outer end portion of a horizontally positioned, clockwise rotating yarn package tube as viewed from the outer end of the yarn package tube, which is mounted on a yarn winder having a yarn traverse guide reciprocating to one side of the yarn package tube along a path parallelly spaced from the package portion of the yarn package tube, the yarn package tube having at its outer axial end an end slit for snagging and retaining yarn, the transfer tail apparatus comprising;

a first yarn guide means mounted in spaced relationship outwardly from the outer axial end of the yarn package tube;

a second yarn guide means mounted spaced outwardly parallel to the axis of the yarn package tube and adjacent to the outer end portion of the yarn package tube;

each of the first and second yarn guide means adapted to receive, retain and engagingly guide a continuously moving yarn from a source of supply when the continuously moving yarn approaches the yarn package tube from above the second yarn guide means and to guide yarn initially to a waste receiver with the path of the yarn being defined through and from the second yarn guide means to, through and from the first yarn guide means, and then to the waste receiver;

the first yarn guide means adapted as mounted to be moved from a first position to a latched second position, and upon release, to be moved in return to the first position along a predetermined path that lies in a horizontal plane extending across and outwardly from the outer axial end of the yarn package tube and thereby adapted to translate the continuously moving yarn into engagement with the outer axial end of the rotating yarn package tube for subsequent snagging by the end slit at the outer axial end of the yarn package tube as the end slit comes around in clockwise manner to about the 10 o'clock position whereupon the yarn is snagged by the end slit and retained on the yarn package tube and becomes severed from the yarn going to the second yarn guide means and to the waste receiver;

the second yarn guide means adapted as mounted to be moved from a first position to a latched second position, and upon release, to be moved in return to the first position along a predetermined path that lies in a horizontal plane along said one side of the yarn package tube and adapted in one position to guide the thus engaged continuously moving yarn into a waste bunch as the yarn package tube rotates, and adapted as it moves in the predetermined path to guide the yarn into spaced helical wraps from the waste bunch to the yarn package portion, and then to release the yarn for subsequent pickup by the yarn traverse guide for forming the yarn package on said yarn package portion; and each of the first and second yarn guide means including a latch means for latching the yarn guide means in the latched second position, a release means for releasing the yarn guide means from the latched second position, and means for moving the yarn guide means in return to the first position;

the release means for the second yarn guide means being actuated for release of the second yarn guide means from the latched second position in response to continued movement of the first yarn guide means toward the first position following the snagging and severing of the yarn, wherein the latch means for the first yarn guide means includes means for actuating the release means for the second yarn guide means.

6. A transfer tail apparatus adapted to form a transfer tail on the outer end portion of a rotating yarn package tube, which is mounted on a yarn winder having a yarn traverse guide reciprocating along a path parallelly spaced from the package portion of the yarn package tube, the yarn package tube having at its outer axial end yarn snagging means for snagging and retaining yarn on the yarn package tube, the transfer tail apparatus comprising:

a first and second yarn guide means for receiving through each and engaging a continuously moving yarn from a source of supply to a yarn waste receiver, the second guide means being generally U-shaped in configuration and having two spaced leg portions inclined upwardly and lying in planes extending above the axis of the yarn package tube and extending generally toward the yarn package tube with a first leg portion being offset below and toward the second leg portion, the second leg portion terminating in an L-shaped leg portion that lies above the end of the first leg portion, that is generally parallel with the yarn package tube and that extends in a direction toward the outer axial end of the yarn package tube;

the first yarn guide means mounted spaced outwardly from the outer axial end of the yarn package tube so as to move in a predetermined path relative to said outer axial end and to translate the thus engaged continuously moving yarn into engagement with the outer axial end of the yarn package tube whereupon the yarn snagging means rotates into snagging position, snags and retains the yarn on the yarn package tube thereafter causing the yarn to become severed from the yarn going to the waste receiver and to be released from the first yarn guide means;

the second yarn guide means mounted spaced outwardly parallel to the axis of the yarn package tube and adjacent to the outer end portion of the yarn package tube and adapted as mounted after the retention of the yarn on the yarn package tube and the yarn is being wound thereon as the yarn package tube rotates to move in a predetermined path at a predetermined rate relative to the speed of rotation of the yarn package tube and to guide the thus engaged yarn along the length of the end portion of the yarn package tube so that a transfer tail of spaced helical wraps is formed along said end portion, and is also adapted at a predetermined point along its path of movement to move out of engagement with and thus release the yarn for subsequent pickup of the yarn by the yarn traverse guide for winding of the yarn package on the package portion of the yarn package tube; and means for moving the first and second yarn guide means.

7. A transfer tail apparatus adapted to form a transfer tail on the outer end portion of a rotating yarn package tube, which is mounted on a yarn winder having a yarn traverse guide reciprocating along a path parallelly spaced from the package portion of the yarn package tube, the yarn package tube having at its outer axial end yarn snagging means for snagging and retaining yarn on the yarn package tube, the transfer tail apparatus comprising:

a first yarn guide means mounted spaced outwardly from the outer axial end of the yarn package tube and a second yarn guide means mounted spaced outwardly parallel to the axis of the yarn package tube and adjacent to the outer end portion of the yarn package tube, each guide means adapted to receive, retain and engagingly guide a continuously moving yarn from a source of supply to a waste receiver and adapted as mounted so as to be moved in a predetermined path from a first position to a latched position, and upon release, to be moved in return along a predetermined path to the first position;

each guide means including a latch means for latching the guide means in the latched second position, a release means for releasing the guide means from the latched second position, and means for moving the guide means in return to the first position;

the first guide means adapted upon release from the latched position and movement in return along the predetermined path toward the first position to translate the thus engaged continuously moving yarn into engagement with the outer axial end of the yarn package tube whereupon the yarn snagging means rotates into snagging position, snags and retains the yarn, thereafter causing the yarn to become severed from the yarn going to the waste receiver and to be released from the first guide means;

the second guide means adapted as mounted in the latched second position to guide the thus engaged continuously moving yarn into a waste bunch of predetermined number of wraps on the outer end portion of the rotating yarn package tube, and upon release from the latched second position and movement in return along the predetermined path toward the first position to guide the yarn into a predetermined number of spaced helical wraps along the yarn package tube between the waste bunch and the package portion of the yarn package tube as the second guide means moves and is also adapted at a predetermined point along its path of movement to move out of engagement with and thus release the yarn from the second guide means for subsequent pickup by the yarn traverse guide for winding of the yarn package on the package portion of the yarn package tube, the second guide means being generally U-shaped in configuration and having two spaced leg portions inclined upwardly and lying in planes extending above the axis of the yarn package tube and extending generally toward the yarn package tube with a first leg portion being offset below and toward the second leg portion, the second leg portion terminating in an L-shaped leg portion that lies above the end of the first leg portion, that is generally parallel with the yarn package tube and that extends in a direction toward the outer axial end of the yarn package tube; and the release means for the second guide means being actuated for release of the second guide means from the latched second position in response to continued movement of the first guide means toward the first position following the snagging and severing of the yarn.

* * * * *